US005176542A

United States Patent [19]

Grappe

[11] Patent Number: 5,176,542

[45] Date of Patent: Jan. 5, 1993

[54] ELECTRICAL CONNECTOR FOR PASSING VERY HIGH CURRENTS

[75] Inventor: René Grappe, Paris, France

[73] Assignee: Souriau & Cie, Cedex, France

[21] Appl. No.: 822,044

[22] Filed: Jan. 17, 1992

[30] Foreign Application Priority Data

Jan. 17, 1991 [FR] France ..... 91 00504

[51] Int. Cl.[5] ..... H01R 13/00

[52] U.S. Cl. ..... 439/821; 439/843

[58] Field of Search ..... 439/825, 821, 826, 827, 439/843, 816, 844, 851

[56] References Cited

U.S. PATENT DOCUMENTS

| | | | |
|---|---|---|---|
| 2,280,728 | 4/1942 | Streib | 439/843 |
| 3,601,776 | 8/1971 | Curl | 439/825 |
| 3,956,607 | 5/1976 | Wijnandsbergen . | |
| 4,390,218 | 6/1983 | Kruger . | |
| 4,662,706 | 5/1987 | Foley | 439/843 |

FOREIGN PATENT DOCUMENTS

| | | |
|---|---|---|
| 0254986 | 2/1988 | Fed. Rep. of Germany . |
| 2622361 | 4/1989 | France . |

*Primary Examiner*—Joseph H. McGlynn
*Attorney, Agent, or Firm*—Larson and Taylor

[57] ABSTRACT

An electrical connector for interconnecting two electrically conductive members suitable for conveying very high currents, in particular short circuit currents, the connector comprising: a first connector part provided with a socket; a second connector part suitable for being coupled mechanically to the first part, and provided with a pin suitable for being received in the socket when the two parts are coupled together, each of the two parts having at least one axially-extending annular skirt respectively around the socket and around the pin, and at least one contiguous annular recess shaped and positioned to receive the annular skirt of the other connector part when the two parts are coupled together, and at least two contact rings disposed concentrically and at least approximately in mutual radial alignment, the rings being interposed between the mutually engaged facing surfaces of the socket, the pin, and the skirts when the two connector parts are coupled together.

8 Claims, 2 Drawing Sheets

ELECTRICAL CONNECTOR FOR PASSING VERY HIGH CURRENTS

FIELD OF THE INVENTION

The present invention relates to an electrical connector for interconnecting two electrically conductive members suitable for conveying very high currents, in particular short circuit currents, the connector comprising:

- a first connector part which is provided with at least one bore parallel to its axis and constituting a socket;
- a second connector part suitable for being mechanically coupled with the first connector part and which is provided with at least one pin-forming finger suitable for being received in said bore when the two connector parts are coupled together; and
- at least one annular contact in the form of a ring carried by one of said first and second connector parts to provide an electrical connection between the socket and the pin.

BACKGROUND OF THE INVENTION

Electrical connectors of the above type are already known, e.g. from Document FR-A-2 622 361 in the name of the present Applicant.

The current-passing capacity offered by each contact ring is a function, in particular, of its geometrical shape and of the number of points of contact that it provides with the two surfaces between which it is interposed. For a given diameter of connector pin and socket, and thus for a given diameter of ring, it is conventional to make the connector suitable for withstanding currents higher than those normally expected for a single ring by increasing the number of rings, with the rings being placed one after another.

Naturally, in order to enable an appropriate number of rings to be installed, such an arrangement increases the length of the pin and of the socket, and thus the overall length of the connector. This increase in length leads to a corresponding increase in the volume of metal constituting the connector and thus to an increase in its weight and in its cost. This is not acceptable in certain applications (e.g. aviation or space applications) in which constraints on weight and on bulk are particularly severe.

In addition, from the electrical point of view, such an arrangement of rings one after the other is particularly unfavorable. In particular when passing alternating currents, the contacts (the socket and the pin) and the contact rings are subjected to large electrodynamic forces that may move the contacts out-of-true. While being moved out-of-true, the rings are subjected to radial deformation (on one side the points of contact are crushed with a considerable increase in contact area and a considerable reduction in current density at each point of contact, while on the diametrically opposite other side the points of contact are mechanically de-stressed with a significant reduction in contact area and an increase in the current density at each point of contact). Such deformation takes place simultaneously and in the same direction for all of the rings, thereby giving rise to operating conditions that are not favorable for the connector.

An essential object of the invention is to remedy these drawbacks by providing an improved arrangement for a connector having a plurality of contact rings, thereby obtaining a connector that is more compact, lighter in weight, and possibly less expensive than the connectors presently in use, and which, in addition, provides electrical operation that is more satisfactory and more reliable.

SUMMARY OF THE INVENTION

To this end, an electrical connector of the invention is as defined above and in addition: each of the first and second connector parts presents at least one axially-extending annular skirt respectively around the socket and around the pin, and at least one contiguous annular recess shaped and positioned to receive the annular skirt of the other connector part when the two parts are coupled together; and the connector includes at least two contact rings disposed concentrically and approximately in mutual radial alignment, said rings being interposed between the facing surfaces of the socket, the pin, and the skirts as mutually engaged within one another when the two connector parts are coupled together.

It is practical for each ring to be retained in an annular groove formed in one of the co-operating surfaces of the socket and/or of the pin and/or of the skirts.

In one possible embodiment, all of the contact rings individually associated with a pair of contact surfaces between the socket and/or the pin and/or the skirts are carried by surfaces having the same radial orientation (facing radially inwards or facing radially outwards). This disposition gives rise to an arrangement that is advantageous for protecting the rings against shock while the two connector parts are not coupled together, in which arrangement all of the contact rings are carried by surfaces that face inwards, which surfaces are sheltered when the two connector parts are not assembled together.

It is advantageous, in a manner that is known per se, for each contact ring to be constituted by a strip of resiliently deformable material shaped approximately in the form of a Greek fret, or an analogous shape imparting radial resilience thereto.

In order to provide better electrical contact, it is also advantageous, likewise in conventional manner, for each ring to be curved transversely so that its edges bear against its supporting surface and so that its center bears against the co-operating surface facing its supporting surface.

Naturally, there is nothing to prevent the disposition of the present invention (concentrically disposed rings) from being combined with the disposition used in the past (rings disposed one after the other) such that when it is necessary to use a large number of rings, the resulting compromise serves to reduce the longitudinal size of the connector without thereby giving rise to an excessive increase in its diameter. Thus, the connector may be provided with a plurality of rings disposed in a plurality of concentric groups each comprising a plurality of rings disposed one after the other.

BRIEF DESCRIPTION OF THE DRAWINGS

The invention will be better understood on reading the following detailed description of a particular embodiment given purely by way of example. The description refers to the accompanying drawings in which highly diagrammatic

DETAILED DESCRIPTION

Figure 1:
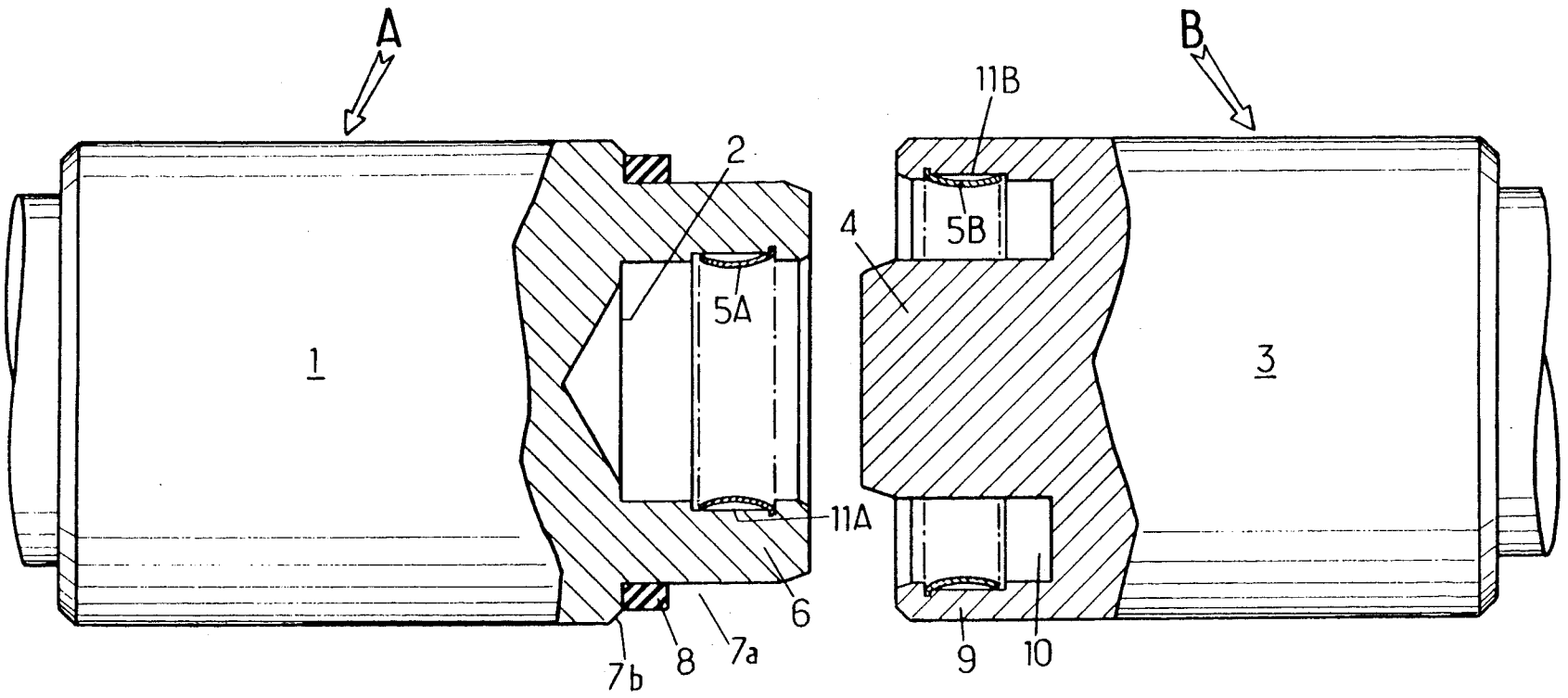
FIGS. 1 and 2 show an electrical connector organized in accordance with the invention and drawn in two different functional positions (respectively uncoupled and coupled together).

The electrical connector shown in the drawings comprises two connector parts suitable for being coupled together, namely a connector part A comprising a body 1 provided with an axial bore 2 opening out into the front face of said body 1 and forming a socket, and a connector part B comprising a body 3 provided with a portion projecting axially from the front face of said body and forming a pin 4. The shape and dimensions of the pin are such as to enable it to be received in the bore 2 when the two connector parts A and B are coupled together. In the description below, the part A is referred to as the "female" part and the part B is referred to as the "male" part.

Naturally, the respective rear portions of both connector parts A and B (not shown in the drawings) are shaped so as to be suitable for connection to respective conductors.

The figures show only those portions of the connector parts A and B that are necessary for understanding the invention.

At least the respective leading portions of the bodies 1 and 3 of the two connector parts A and B are made in solid form, i.e. the pin 4 and the socket 2 are machined (e.g. by turning) from metal blocks, e.g. copper blocks, and the surfaces through which electrical current is to be conveyed may additionally be gold-plated.

Electrical current is conveyed between two coupled-together connector portions A and B via annular contacts 5 in the form of rings which are interposed between the facing surfaces of the part A and of the part B, respectively. In accordance with the invention, these contact rings 5 are no longer disposed axially one after another between the pin and the socket as used to be the case for prior art connectors (see Document FR-A-2 622 361), for example, but instead they are disposed concentrically relative to each other and they are at least approximately in alignment radially.

Figure 2:
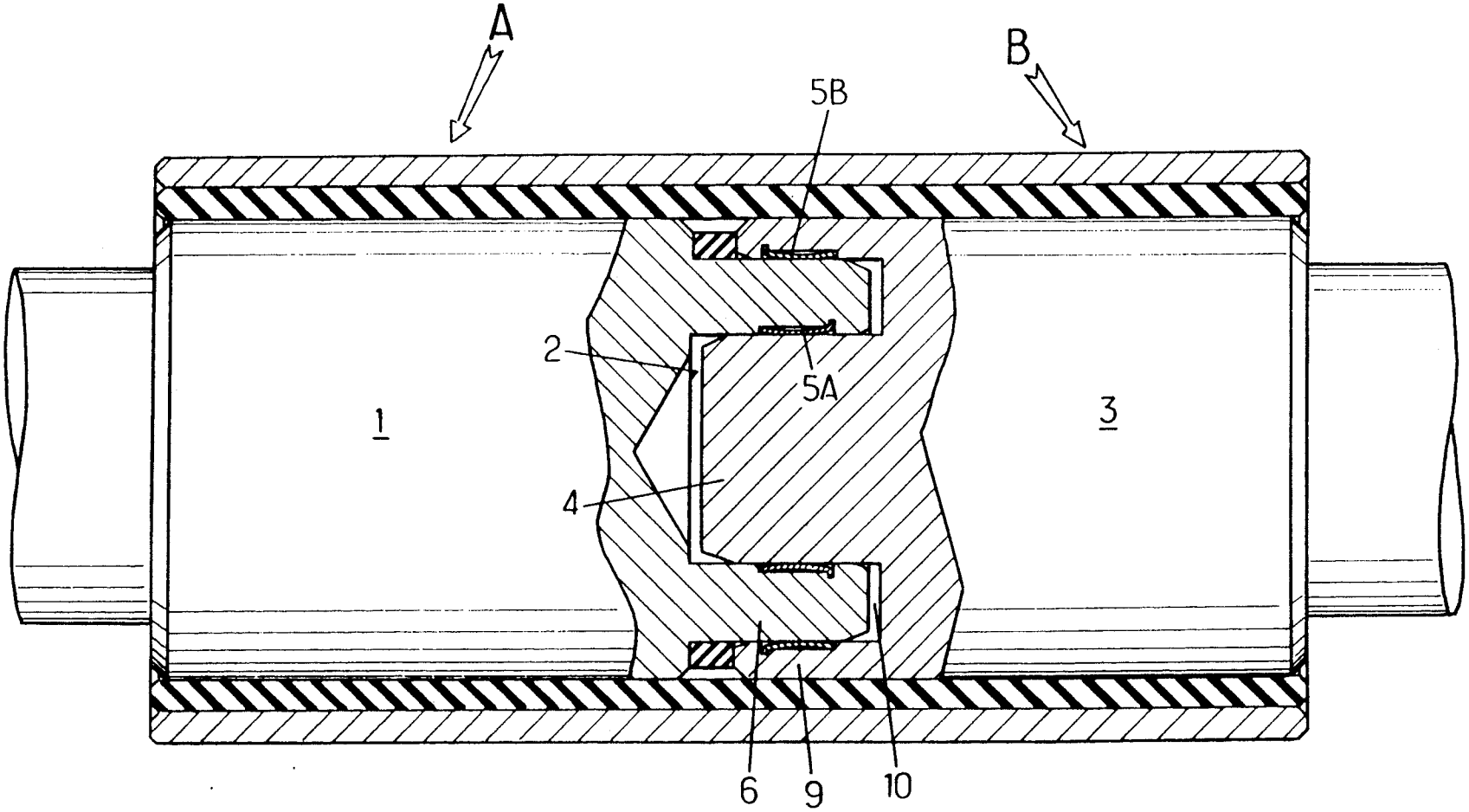

It is therefore necessary for the bodies of the parts A and B to be shaped specially for supporting the contact rings. To this end, the number of co-operating annular surfaces between the parts A and B must be increased to match the number of contact rings that are to be used. The embodiment shown in FIGS. 1 and 2 is organized to provide two contact rings. To this end, the bore 2 is formed in an annular portion of the body 1 constituting an annular ring 6 having an outside diameter which is smaller than the outside diameter of the body 1 so as to leave an outer annular recess 7*a* which is terminated by an outer annular shoulder 7*b* against which a sealing gasket 8 is disposed. In corresponding manner, the body 3 of the male part B has an annular skirt 9 surrounding the pin 4 at a radial distance therefrom so as to define in co-operation therewith an annular housing 10. The dimensions and shape of the annular housing 10 are suitable for receiving the annular skirt 6 of the female part A when the two parts A and B are coupled together, with the skirt 9 of the male part B then being received in the outer recess 7*a* which surrounds the skirt 6 of the female part A and coming into abutment against the sealing gasket 8 (see FIG. 2).

An annular groove 11A is formed in the side wall of the bore 2 and a contact ring 5A is received therein. An annular groove 11B is formed in the outer wall of the housing 10 and a contact ring 5B is received therein.

The contact rings 5A and 5B are shaped in any manner that is appropriate for their function. In this context, reference may be made in particular to Document FR-A-2 622 361. Stated briefly, each contact ring is constituted by a strip of resiliently deformable material approximately in the shape of a Greek fret or in a similar shape imparting radial resilience thereto. Each ring is curved transversely so as to thrust its edges against the bottom of the groove in which it is supported and is curved centrally against the facing co-operating surface belonging to the other part when the two parts A and B are coupled together (FIG. 2). When the two parts are not coupled together, the central portion of each ring projects radially relative to the surrounding surface (FIG. 1). In other words, all of the rings 5 are disposed so that their respective transverse concave sides face in the same radial direction.

Each of the rings is carried by the corresponding inside face of the bore 2 and of the annular housing 5, i.e. they are carried by annular surfaces of the connector parts A and B that have the same radial orientation: in this case, both of the surfaces face radially inwards, which disposition provides the advantage of protecting the rings from external shocks when the two connector portions A and B are not coupled together.

The number of annular grooves and skirts provided on the connector portions A and B is a function of the number of contact rings that the connector needs to include. However, in order to avoid increasing the diameter of the connector excessively when the number of such rings is large, it is possible to envisage combining the previously-used disposition in combination with the disposition of the present invention, i.e. to distribute the rings in a plurality of groups, each comprising a plurality of rings disposed one after the other. For example, the connectors shown in FIGS. 1 and 2 could be fitted with four rings, namely two rings 5A disposed one after the other on the female part A, and two rings 5B disposed one after the other on the male part B.

Naturally, and as follows from the above, the invention is not limited to those applications and embodiments that are described in particular; on the contrary, the invention covers any variants thereof.

I claim:

1. An electrical connector for interconnecting two electrically conductive members suitable for conveying very high currents, in particular short circuit currents, the connector comprising:

a first connector part which is provided with at least one bore parallel to its axis and constituting a socket;

a second connector part suitable for being mechanically coupled with the first connector part and which is provided with at least one pin-forming finger suitable for being received in said bore when the two connector parts are coupled together; and at least one annular contact in the form of a ring carried by one of said first and second connector parts to provide an electrical connection between the socket and the pin;

wherein each of the first and second connector parts presents at least one axially-extending annular skirt respectively around the socket and around the pin, and at least one contiguous annular recess shaped and positioned to receive the annular skirt of the other connector part when the two parts are coupled together; and wherein the connector includes at least two contact rings disposed concentrically and approximately in mutual radial alignment, said rings being interposed between the facing surfaces of the socket, the pin, and the skirts as mutually engaged within one another when the two connector parts are coupled together.

2. An electrical connector according to claim 1, wherein each ring is retained in an annular groove formed in one of the cooperating surfaces of the socket and/or of the pin and/or of the skirts.

3. An electrical connector according to claim 1, wherein each contact ring is constituted by a strip of resiliently deformable material shaped approximately in the form of a Greek fret, or an analogous shape imparting radial resilience thereto.

4. An electrical connector according to claim 1, fitted with a plurality of rings disposed in a plurality of concentric groups each comprising a plurality of rings disposed one after the other.

5. An electrical connector according to claim 1, wherein all of the contact rings individually associated with a pair of contact surfaces between the socket and/or the pin and/or the skirts are carried by surfaces having the same radial orientation.

6. An electrical connector according to claim 5, wherein all of the contact rings are carried by surfaces that face inwards, which surfaces are sheltered when the two connector parts are not assembled together.

7. An electrical connector according to claim 1, wherein each ring is curved transversely so that its edges bear against its supporting surface and so that its center bears against the cooperating surface facing its supporting surface.

8. An electrical connector according to claim 7, wherein all of the rings are disposed so that their transverse concave sides face in the same radial direction.

* * * * *